United States Patent [19]

Kersten

[11] 4,279,225

[45] Jul. 21, 1981

[54] ROTARY VALVE ENGINE

[76] Inventor: Herbert H. Kersten, 730 Wraywood Dr., Fort Dodge, Iowa 50501

[21] Appl. No.: 29,326

[22] Filed: Apr. 12, 1979

[51] Int. Cl.[3] ..... F01L 7/00

[52] U.S. Cl. ..... 123/80 BB; 123/190 BA

[58] Field of Search ..... 123/80 R, 80 BA, 80 BB, 123/80 D, 80 DA, 144, 151, 190 R, 190 A, 190 AA, 190 B, 190 BA, 190 BB, 190 BC, 190 D, 190 DA; 137/625.23

[56] References Cited

U.S. PATENT DOCUMENTS

| | | | |
|---|---|---|---|
| 1,096,544 | 5/1914 | Krayer | 123/190 BA |
| 1,571,465 | 2/1926 | Bair | 123/190 BA |
| 2,019,043 | 10/1935 | Braunwalder | 123/190 BA |
| 3,603,299 | 9/1971 | Lamperti | 123/190 D |
| 3,945,359 | 3/1976 | Asaga | 123/80 BB |
| 4,134,381 | 1/1979 | Little | 123/80 BA |

FOREIGN PATENT DOCUMENTS

| | | | |
|---|---|---|---|
| 632728 | 12/1949 | United Kingdom | 123/190 BA |

*Primary Examiner*—Craig R. Feinberg
*Assistant Examiner*—W. Wolfe
*Attorney, Agent, or Firm*—Zarley, McKee, Thomte, Voorhees & Sease

[57] ABSTRACT

The rotary valve engine of the present invention comprises an engine block containing four power cylinders and a central valve cylinder. A single valve port is located in each cylinder just above the maximum travel of the piston. This port serves alternately as an intake port and as an exhaust port. A valve spool is rotatably mounted in the valve cylinder and includes a fuel-air channel in communication with a source of fuel-air mixture and an exhaust port in communication with the atmosphere. The valve spool is rotatable to cause the fuel-air channel and the exhaust channel to move into sequential communication with the valve port of each power cylinder so as to provide charging and exhausting of the power cylinders in proper succession. Two crank shafts are provided, and are linked together by external gears to cause synchronous counter-rotation in such a manner that intake compression, power and exhaust strokes are coordinated and the inertial forces of the engine are counter balanced at all times.

The rotary control valve core is mechanically linked to the crankshafts to provide one revolution of the valve for each two revolutions of the crankshaft. There are three forms of ignition. One is a conventional ignition of a conventional fuel-air mixture using spark plugs or glow plugs. The second uses a flame jet from a secondary rotating valve head linked to the main rotary valve, injecting in high pressure small jet of burning air-fuel "rich" mixture into the compressed "lean" air-fuel mixture already inside the cylinder. The third achieves a stratified charge effect in a novel manner by injecting a small secondary charge of fuel into the previously compressed air-fuel mixture, creating a small local zone of rich mixture in the immediate vicinity of the spark plug or glow plug at the precise moment of ignition.

9 Claims, 10 Drawing Figures

ROTARY VALVE ENGINE

BACKGROUND OF THE INVENTION

This invention relates to a rotary valve engine. The use of rotary valves in engines is not new, but their use has resulted in several problems. One problem is the difficulty in obtaining dynamic balance of the engine. Because the cylinders are usually located in a linear arrangement with a single crankshaft, the balance of the engine is imperfect and excessive vibration results, being worst at certain rotational frequencies than at others.

Another problem common to traditional internal combustion engines is the production of excessive emissions resulting from incomplete combustion, or combustion at excessive temperatures.

Another problem encountered with present devices is the heating of the rotating valve as the result of the exhaust gases passing therethrough. Severe heating of the valve rotor creates expansion problems and bearing problems.

Presently known rotary valve engines are often heavy and cumbersome and for this reason are not regarded as being practical.

SUMMARY OF THE INVENTION

The present invention utilizes a rotary valve core or rotor located centrally with respect to four working cylinders. The engine uses two counter-rotating crankshafts, each one of which is fully functional, in contradistinction to existing engines which employ a second non-working crankshaft solely for purposes of controlling vibration. The valve core is connected mechanically to the output shafts of the engine so as to complete one revolution while the two working crankshafts complete two revolutions.

Each crankshaft is linked to two adjacent pistons in such a manner that they are 180° out of phase with one another, one being in maximum compression while its partner is in maximum expansion with reference to the combustion chamber of each.

The two crankshafts are linked together by gears in such a manner that they rotate in opposing directions. Diagonally opposite pistons work in phase with one another.

This arrangement results in a condition of static balance of the reciprocating parts at rest, and nearly perfect dynamic balance at all speeds of operation.

Three variations of the basic system are proposed, each differing from the others in details of fuel admission and fuel ignition. One system of fuel ignition is conventional, using spark plugs or glow plugs.

A novel system of ignition utilizes a rotating extension of the rotary valve which is linked to the rotary valve core so as to rotate with it. In this system a rich air-fuel mixture is introduced from an external compressor into the combustion chamber of each cylinder at the point of maximum compression, said rich mixture being ignited within the valve extension by a spark or glow plug, and then expanding explosively into the combustion chamber, where it ignites a lean air-fuel mixture secondarily. This flame jet then rotates in succession to the other cylinders, igniting them in turn.

A second novel system of ignition is provided as another alternate, using fuel injection to supplement basic fuel intake with a second richer charge in the vicinity of the spark plug or glow plug at the moment of maximum compression. The primary charge of fuel can be introduced with either a carburetor mixing the fuel with the intake air and introduced through the rotary valve or introduced as a preliminary direct injection into the cylinder at some time after the exhaust phase of the previously completed cycle, and prior to the point of maximum compression.

The two unconventional ignition systems provide sequential ignition of the basic charge in the combustion chamber by beginning combustion in a rich mixture which then extends throughout the lean mixture of each piston. It has been found that exhaust emissions are reduced by this type of ignition.

With the exclusive use of direct fuel injection the valve core is simplified by eliminating the rotary fuel injection core, and its associated external compressor-carburetor.

All variations of the engine introduce the intake air through the valve core by way of connecting channels in the engine block, or, in the case of fuel injection, through the cylinder head port above the central rotary valve.

All variations of the engine exhaust the spend products of combustion through the rotary valve core and then through channels in the engine block to exhaust manifolds located externally.

Intake air and exhaust gases enter and leave the respective cylinders through a single port located just above the point of maximum piston travel in each cylinder.

(It is apparent that a conventional valving system utilizing reciprocating valves and separate intake and exhaust manifolds could be adapted to this general engine configuration and would share in the vibration reducing qualities of the counter-rotating crankshafts.)

A primary object of the present invention is the provision of two counter-rotating working crankshafts, each linked to two pistons moving in opposite directions, and all linked together so that each of four pistons is caused to move in directly opposite paths to the two pistons adjacent to it, and with all four pistons grouped symmetrically around a central axis.

In the preferred embodiment the central axis between the cylinders contains a rotary valve core with two channels, one for intake of air or air-fuel and the other for exhaust of combustion products. The central valve core rotates in successive communication with the combustion space above each cylinder through a single valve port in each cylinder, and it communicates with intake channels and exhaust channels in the engine block or cylinder head to intake and to exhaust manifolds.

Such a rotary valve eliminates in large part the vibration associated with conventional reciprocating valves and their operating cams, and the torsional variations associated with a single crankshaft.

A further object of the present invention is the provision of a unique means for igniting the compressed air-fuel mixture in each cylinder by the use of a rotary intake valve which introduces a flame jet under high pressure at the proper moment in the cycle. This flame jet utilizes a rich air-fuel mixture to more completely ignite the lean mixture within the cylinder.

A further object of the invention is the provision of an alternate ignition method using spark plugs or glow plugs, but augmenting combustion by the injection of a small but separate charge of fuel into the compressed mixture within the cylinder at the moment of ignition so as to provide an alternate method for achieving more complete combustion and greater fuel efficiency.

A further object of the invention is the use of a single valve core for intake and exhaust function so as to permit the heat of the exhausted gases to be partially absorbed by the metal valve core and to be transferred to the incoming air-fuel mixture, thus preheating it, and moderating the temperatures of the valve core.

A further object of the present invention is the weight reduction inherent in grouping four cylinders closely together in a single block around a central axis.

A further object of the present invention is the use of a single port within each cylinder for intake and exhaust, moderating the temperature variations of the port by the alternate passage of hot and cool vapors through it.

A final object of the invention is the provision of an engine which has many fewer moving parts than conventional engines, with resulting economies of manufacture.

DETAILED DESCRIPTION OF THE INVENTION

Figure 1:
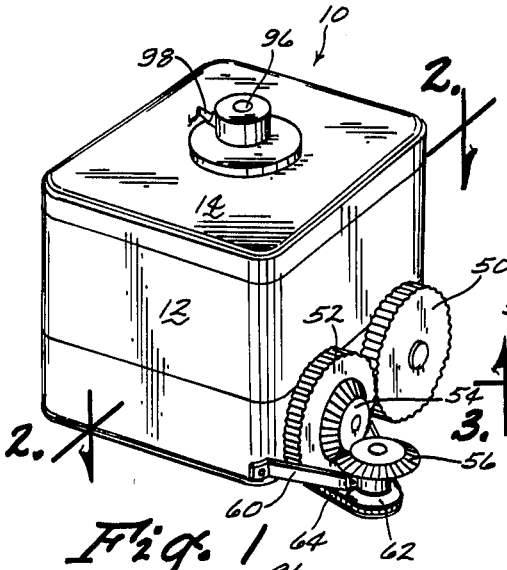
FIG. 1 is a perspective view of the flame-jet embodiment of the present invention.

Referring to the drawings, the numeral 10 generally designates the rotary valve engine of the present invention. Engine 10 includes a housing which is comprised of an engine block 12, and an engine head 14.

Engine block 12 includes four vertical power cylinders 16, 18, 20 and 22 and a valve cylinder 24 located centrally with respect to power cylinders 16, 18, 20, and 22. Extending from each of cylinders 16, 18, 20 and 22 to provide communication to valve cylinder 24 is a bore or port 26. Adjacent the upper end of valve cylinder 24 is an exhaust channel opening 28 (FIGS. 2 and 3) which provides communication from valve cylinder 24 to a source of fuel air supply (not shown) outside block 12.

Figure 4:
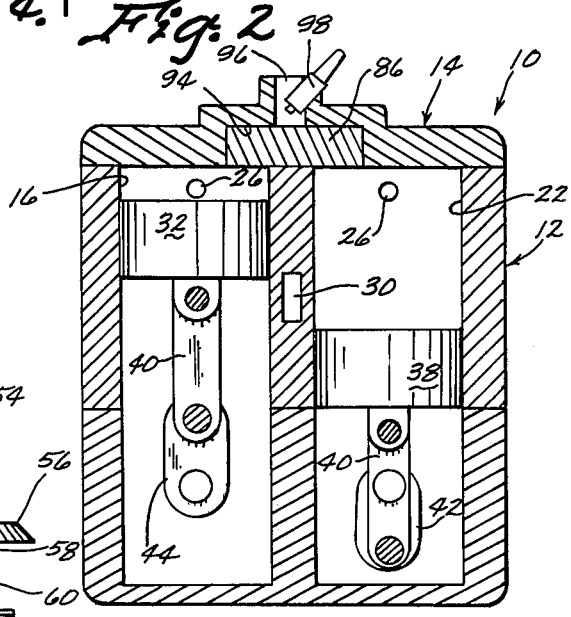

Located slightly below exhaust channel opening 28 is a fuel-air opening 30 (FIGS. 2 and 4) which provides communication from the interior of valve cylinder 24 to the exterior of block 12.

Mounted within cylinders 16, 18, 20 and 22 are four pistons 32, 34, 36, 38, respectively. Each piston includes a piston rod 40 pivotally connected thereto and extending downwardly therefrom. Rotatably journaled in the bottom of engine block 12 for rotation about two horizontal axes, are a pair of crank shafts 42, 44, each of which has output shaft ends 46, 48 extending to the exterior of engine block 12.

On output shaft ends 46, 48 are planetary gears 50, 52 which intermesh with one another so that rotation of shaft 46 causes complementary rotation of shaft 48, and conversely, rotation of shaft 48 causes counter-rotation of shaft 46.

Protruding outwardly from the face of gear 52 is a beveled gear 54 which is intermeshed with a complementary beveled gear 56. Gear 56 is fixed to a vertical shaft 58 which is rotatably journaled in a bracket 60 and which includes on its lower end a sprocket 62.

Figure 6:
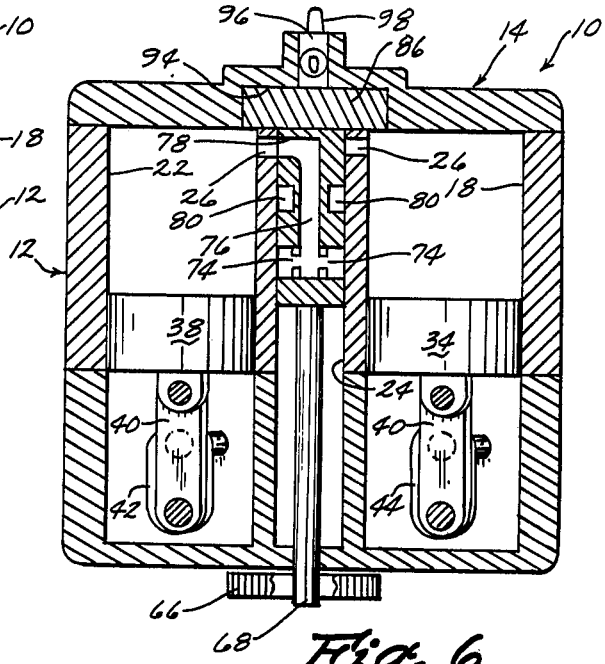
Figure 7:
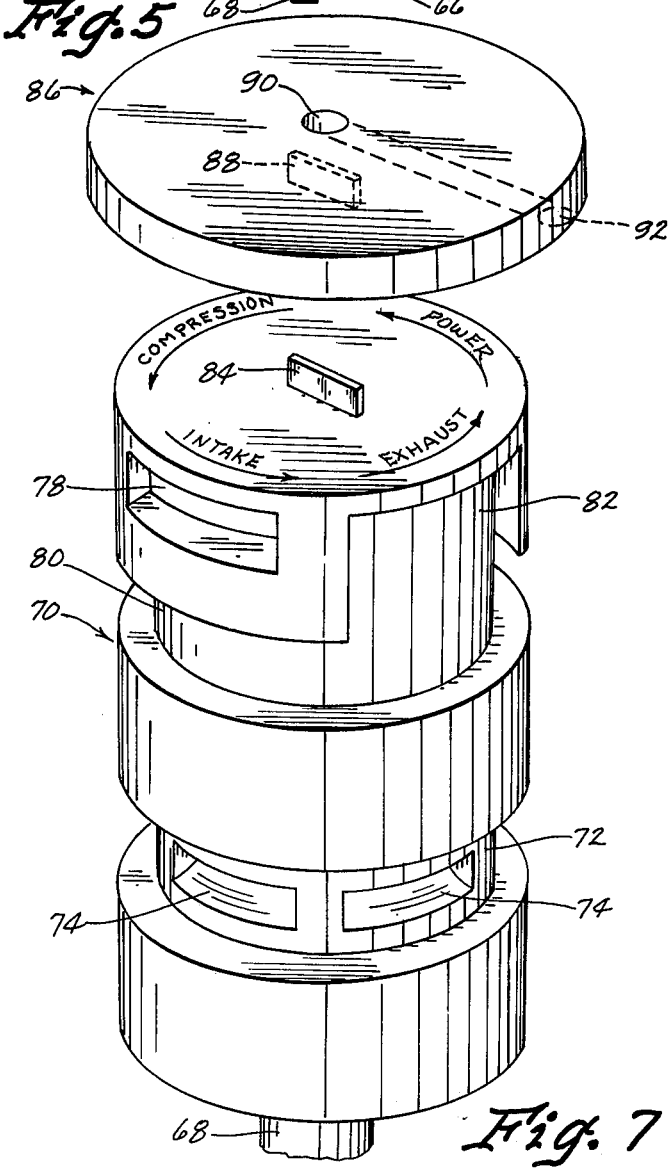

Trained around sprocket 62 is a chain 64 which in turn is trained around a second sprocket 66. Sprocket 66 is fixed to a vertical shaft 68 which is rotatably journaled in engine block 12 and extends upwardly in valve cylinder 24. On the upper end of vertical shaft 68 is a valve spool or rotor 70 (FIG. 7). Rotor 70 is cylindrical in shape and fits within valve cylinder 24 for rotation therein. The arrangement is such as to provide one rotation of the rotor 70 for each two rotations of crankshafts 42 and 44. Adjacent the lower portion of valve 70 in horizontal alignment with fuel-air opening 30 is an annular fuel-air groove 72. A plurality of fuel-air openings 74 provide communication from the inner surface of groove 72 to an interior chamber 76 (FIG. 6) within valve rotor 70. An upper fuel-air opening 78 adjacent the upper end of spool 70 is positioned in horizontal alignment with the various bores or ports 26 leading to each of the cylinders. Rotation of valve rotor 70 causes upper fuel air opening 78 to move into registered alignment with each port 26 one at a time thereby introducing a mixture of fuel and air to the cylinders one at a time and successively.

Immediately above the lower fuel-air groove 72 is an exhaust groove 80 which is in horizontal alignment with exhaust channel opening 28 in engine block 12. Groove 80 includes an upwardly extending notch 82 which is in horizontal alignment with bores 26 of cylinders 32, 34, 36, 38. It should be noted that both upper fuel air opening 78 and notch 82 are in horizontal alignment with ports 26. Thus, upon rotation of spool 70, fuel-air opening 78 and notch 82 alternatively move into successive communication with each port 26, so as to alternatively introduce fuel and air into the cylinders and to exhaust the burned gases from the cylinders.

The upper end of spool 70 includes a key 84. A distributor cap 86 of a larger diameter than spool 80 includes a key slot 88 sized to matingly fit over key 84 so as to cause cap 86 to rotate in unison with spool 70. Protruding downwardly through cap 88 is a spark channel 90. Spark channel 90 has an upper end located at the center of cap 86 and angles radially outwardly and downwardly to a lower end 92.

Figure 2:
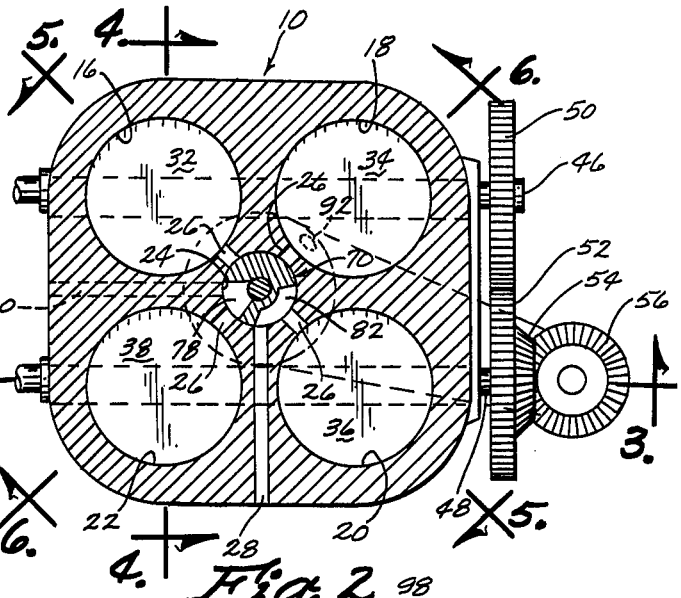
FIG. 2 is a sectional view taken along line 2—2 of FIG. 1.
Figure 3:
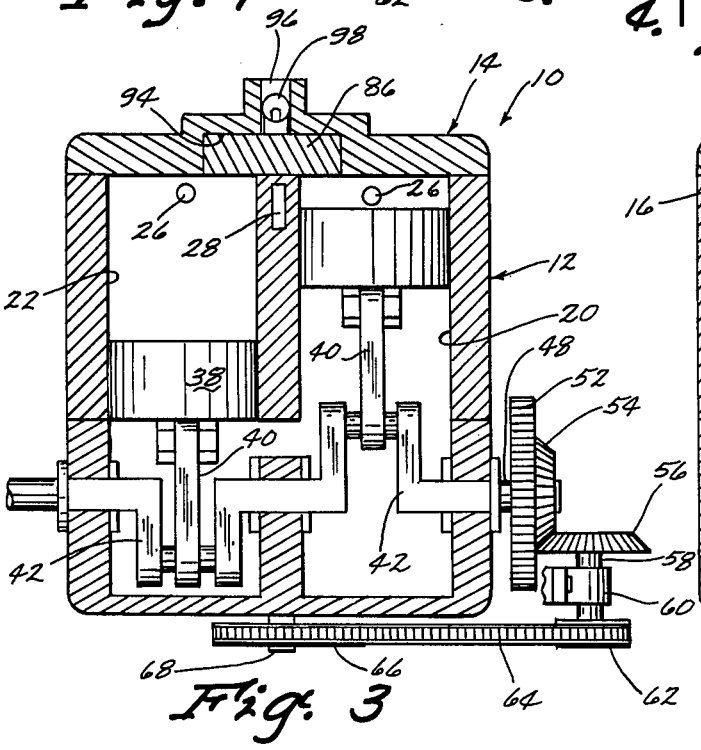
FIGS. 3, 4, 5 and 6 are sectional views taken along lines 3—3, 4—4, 5—5, and 6—6, respectively of FIG. 2.

Cap 90 is of slightly greater diameter than spool 70 and lower end 92 is located radially outwardly from the outer sides of spool 90. Furthermore, lower end 92 of spark channel 90 is adapted to be in communication with the upper ends of cylinders 16, 18, 20 and 22. FIG. 2 illustrates opening 92 in communication with cylinder 18.

Engine head 14 includes a circular recess 94 for receiving cap 86 and permitting rotation of cap 86 in unison with spool 70.

Extending vertically downwardly into head 14 is a channel opening 96 which is in registered alignment with and in communication with the upper end of spark channel 90. Channel opening 96 is adapted to be connected to an enriched mixture of fuel under pressure which exceeds the compression pressure within the cylinders during the compression portion of the piston strokes. A spark plug or glow plug 98 is in communication with channel 96 and is adapted to ignite the pressurized fuel-air mixture to create a flame jet or torch which is introduced through lower end 92 into the cylinders 16, 18, 20 and 22 at the moment of ignition.

Referring to FIG. 2, piston 32 is shown in the uppermost portion of its compression stroke. Piston 34 is shown in the lowermost portion of its power stroke; piston 36 is shown in the uppermost portion of its exhaust stroke; and piston 38 is shown in the lowermost portion of its intake stroke. Valve spool 70 is in a position wherein upper fuel-air opening 78 is in communication with port 26 of cylinder 22, thereby providing a fuel-air mixture during the intake portion of the stroke of piston 38. At the same time, notch 82 of exhaust groove 80 is in registered alignment with port 26 of cylinder 20, thereby providing an avenue of exhaust for gases being driven out of cylinder 20 by piston 36 during its exhaust stroke.

Figure 5:
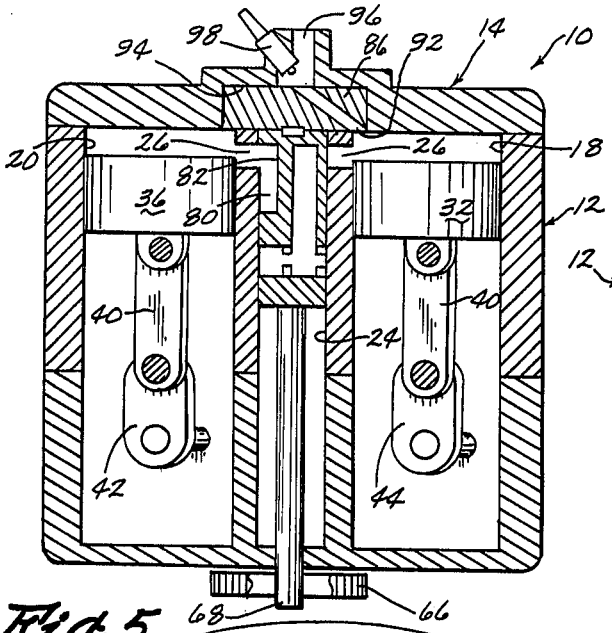

Opening 78 and notch 82 are sealed from ports 26 of cylinders 16 and 18 since these cylinders are in the power and compression strokes, respectively. The lower end 92 of spark channel 90 is in communication with cylinder 18 as shown in FIGS. 2 and 5 so as to introduce combustion into the upper end of the cylinder 18.

Combustion within cylinder 18 causes piston 34 to be depressed into its power stroke which in turn causes rotation of shaft 46, gears 50, 52, 54, 56 and consequently spool 70. Thus, as spool 70 rotates, it brings notch 82 into communication with port 26 of cylinder 18 and brings opening 78 into communication with port 26 of cylinder 20. Thus, rotation of spool 70 causes each of the cylinders to be charged and exhausted in sequence. The rotation of spool 70 is caused in response to the rotation of the output shafts 46.

Because shafts 46, 48 operate in opposite directions, the dynamic balance of the engine is enhanced and vibration is minimized. Similarly, the rotating cap 94 provides an improved ignition apparatus requiring only one sparkplug. While separate sparkplugs could be provided for each of the cylinders, it is believed that the use of the cap 86 provides an improvement over the prior art.

The introduction of the fresh fuel-air mixture into the interior of spool 70 provides two important functions. The spool is heated by the exhaust gases exiting from the cylinders, and the heated spool causes preheating of the fuel-air mixture before it enters the cylinders. This preheating of the air-gas mixture has the secondary desired effect of cooling the metal within the spool so as to minimize problems with expansion and binding.

Figure 8:
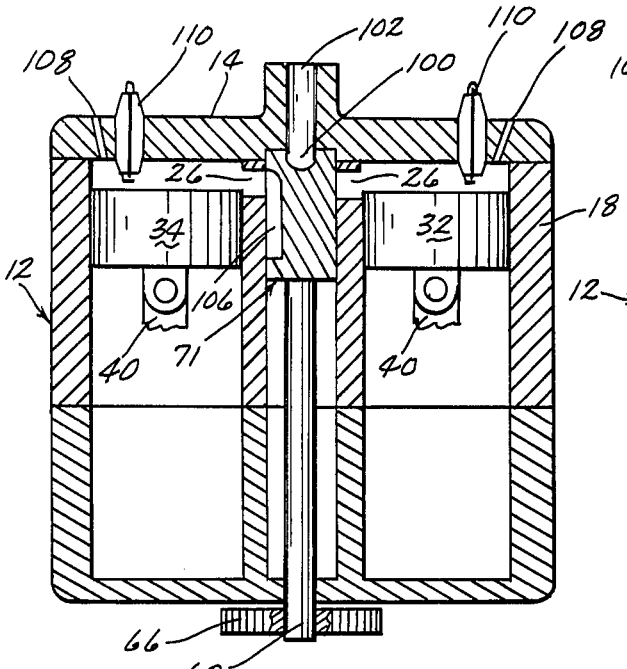
FIGS. 8, 9 and 10 are views corresponding to FIGS. 5, 6 and 7 respectively, but showing an embodiment using direct fuel injection into each cylinder.
Figure 9:
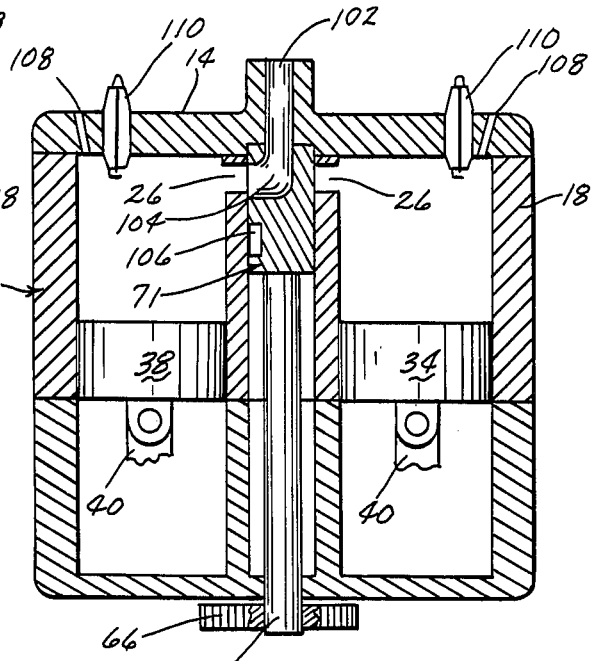
Figure 10:
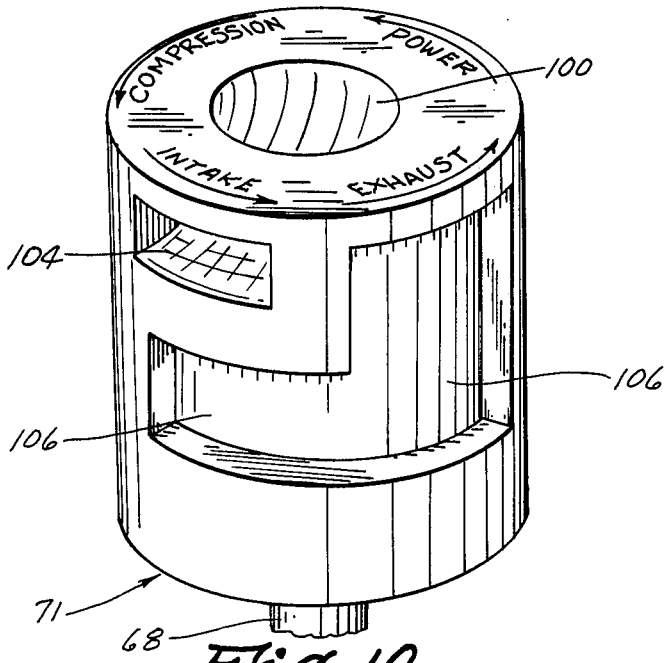

In the variation displayed in FIGS. 8, 9 and 10, the basic arrangement of the engine is the same except for a modified central valve rotor 71 and a modified method of ignition and fuel-enrichment. Valve rotor 71 contains an intake channel 102 which leads from its upper surface, where it communicates with intake manifold 102 in cylinder head 14. Intake channel 102 passes obliquely through rotor 71 to a side port 104. As the rotor rotates side port 104 passes successively the access ports 26 of each working cylinder permitting air or air-fuel mixture to be drawn into each cylinder in turn. Rotor 71 also contains an exhaust recess 73 which permits the passage of exhaust gases from each cylinder in turn during the exhaust phase of its cycle in the same manner as previously described herein.

Fuel injection channels 108 in FIGS. 8 and 9 are located adjacent to spark plugs or glow plugs. Channels 108 permit the injection of fuel into each cylinder. The major "lean" air-fuel charge may be introduced with the intake air through a conventional carburetor, if desired, or may be introduced by direct injection during the intake or compression phases of the cycle. At the precise moment of ignition in either case, a supplemental "enrichment" charge is introduced through these channels in the immediate vicinity of the spark plug or glow plug, creating a small local zone of rich air-fuel mixture. Ignition occurs in this enriched zone and spreads explosively throughout the upper cylinder, permitting more complete ignition and a corresponding reduction in undesirable emissions.

The engine of the present invention has a reduced weight, and therefore is believed to constitute an improvement over the prior art.

The ports 26 are located slightly above the uppermost portion of the piston strokes as illustrated in FIGS. 3–6. This minimizes the sealing problems which would occur if the ports 26 were located further down within the cylinder. Therefore, sealing problems are minimized by virtue of the location of ports 26.

FIGS. 8, 9 and 10 show the embodiment of this engine using fuel injection instead of a conventional carburetor. In this embodiment the rotary valve core is modified to permit the intake of air or an air-fuel mixture through an intake port 102 in the cylinder head, then through an intake channel 100 in valve rotor 71. Exhaust channel 106 conducts products of combustion by way of exhaust channels in the engine block as in 28 in FIG. 3. Fuel injection channels 108 are located near spark or glow plugs 110 to permit introducing a rich supplemental charge of fuel near the spark plug at the moment of ignition. The ignited charge will expand explosively through the cylinder chamber, igniting the compressed lean air-fuel mixture previously introduced therein.

Thus, it will be seen that the device achieves at least all of its stated objectives.

What is claimed is:

1. A rotary valve engine comprising:

an engine housing having a plurality of vertical power cylinders therein each of said cylinders having a cylindrical sidewall and upper and lower axial ends;

an elongated vertical valve cylinder formed in said housing said cylinder having a cylindrical sidewall and upper and lower axial ends;

a plurality of bores in said housing, each of said bores having a first end in communication with one of said power cylinders through said cylindrical sidewall thereof and a second end in communication with said valve cylinder through said cylindrical sidewall thereof, said second ends being positioned in spaced apart relationship around the cylindrical circumference of said valve cylinder at the said axial height within said valve cylinder;

an elongated cylindrical valve spool rotatably mounted in said valve cylinder and having a cylindrical side wall, a fuel air port formed in said spool sidewall and being in communication with a source of fuel air mixture, and an exhaust port formed in said spool sidewall and being in communication with the atmosphere;

said valve spool being rotatable to cause said fuel air port and said exhaust port each to move into communication one at a time with said second ends of said bores;

a reciprocating piston within each of said cylinders;

at least two output shafts;

means connecting each of said output shafts to at least one of said pistons for causing rotation of said output shafts in response to reciprocation of said pistons;

mechanism connecting at least one of said output shafts to said spool for causing rotation of said spool in response to rotation of said output shafts;

gear mechanisms interconnecting said output shafts and said valve spool for causing said spool to rotate in response to rotation of said output shafts so that said valve spool completes one revolution while said output shafts each complete two revolutions;

an exhaust channel extending through said housing and including a first end in communication with said valve cylinder and a second end leading to the exterior of said housing;

said exhaust port of said valve spool comprising an annular exhaust groove in said spool in communication with said first end of said exhaust channel, said annular exhaust groove having an axially upwardly extending notch therein which is movable in communication one at a time with said second ends of said bores leading to said power cylinders;

a fuel air channel extending through said housing and having a first end in communication with said valve cylinder and a second end in communication with a source of fuel-air mixture;

said spool having a central chamber within the interior thereof, an annular fuel-air groove extending therearound and in communication with said first end of said fuel-air channel, and a first chamber opening in said spool providing communication from said fuel air groove to said chamber;

said fuel-air port of said spool comprising a second opening in said spool providing communication from the exterior of said spool to said chamber.

2. A rotary valve engine comprising:

an engine housing having a plurality of power cylinders therein;

an elongated valve cylinder formed in said housing;

a plurality of bores in said housing, each of said bores having a first end in communication with one of said power cylinders and a second end in communication with said valve cylinder, said second ends being positioned in spaced apart relationship around the cylindrical circumference of said valve cylinder;

a valve spool rotatably mounted in said valve cylinder and having a fuel air port in communication with a source of fuel air mixture and an exhaust port in communication with the atmosphere;

said valve spool being rotatable to cause said fuel air port and said exhaust port each to move into communication one at a time with said second ends of said bores;

a reciprocating piston within each of said cylinders;

at least two output shafts;

means connecting each of said output shafts to at least one of said pistons for causing rotation of said output shafts in response to reciprocation of said pistons;

mechanism connecting at least one of said output shafts to said spool for causing rotation of said spool in response to rotation of said output shafts, said housing having a fuel air channel and an exhaust channel extending therethrough, each of said fuel air and exhaust channels having a first end in communication with said valve cylinder, said fuel air exhaust channel having a second end in communication with a source of fuel air mixture and said exhaust channel having a second end in communication with the atmosphere;

said exhaust port of said valve spool comprising an annular exhaust groove in said spool in communication with said first end of said channel, said annular exhaust groove having an axially upwardly extending notch therein which is movable into communication one at a time with said second ends of said bores leading to said power cylinders;

said valve spool further having a central chamber within the interior thereof, an annular fuel air groove extending therearound and in communication with said first end of said fuel air channel, and a first chamber opening in said spool providing communication from said fuel air groove to said chamber; and said fuel air port of said spool comprising a second chamber opening in said spool providing communication from said chamber to the exterior of said spool.

3. An engine according to claim 2 wherein said pistons move between an upper position located at a predetermined height within said cylinders and a lower position, said plurality of bores being located at a height within said cylinders above said predetermined height.

4. An engine according to claim 2 wherein an ignition means is rotatably mounted in said housing for introducing ignition to said power cylinders, said ignition means comprising a channel having an output end for delivering a spark ignition therefrom, all of said power cylinders being in communication with a portion of said ignition means, said output end of said channel being movable into communication with each of said power cylinders in response to rotation of said ignition means.

5. An engine according to claim 4 wherein mechanism interconnect said valve spool and said ignition means for causing them to rotate in unison.

6. An engine according to claim 2 wherein gear mechanisms interconnect said output shafts and said valve spool for causing said spool to rotate in response to rotation of said output shafts so that the valve spool completes one revolution while said output shafts each complete two revolutions.

7. An engine according to claim 6 wherein said gear mechanism includes a first gear on one of said output shafts, a second gear on the other of said output shafts and in meshing engagement with said first gear to cause each shaft to rotate in a direction opposite to its linked partner shaft.

8. An engine according to claim 7 wherein a third gear intermeshes with one of said first and second gears, said third gear being operatively connected to said spool for causing rotation of said spool in response to rotation of said first, second and third gears.

9. An engine according to claim 8 wherein said operative connection between said third gear and said spool comprises a first sprocket fixed to said gear, a second sprocket fixed to said spool, and a chain trained around said first and second sprockets.

* * * * *